US006338907B1

(12) United States Patent
Strelsky

(10) Patent No.: US 6,338,907 B1
(45) Date of Patent: Jan. 15, 2002

(54) ABRASIVE TOOL

(75) Inventor: Wolfgang Strelsky, Vienna (AT)

(73) Assignee: Tyrolit Schleifmittelwerke Swarovski K.G., Schwaz (AU)

( * ) Notice: Subject to any disclaimer, the term of this patent is extended or adjusted under 35 U.S.C. 154(b) by 0 days.

(21) Appl. No.: 09/509,893

(22) PCT Filed: Aug. 3, 1999

(86) PCT No.: PCT/AT99/00194

§ 371 Date: Apr. 3, 2000

§ 102(e) Date: Apr. 3, 2000

(87) PCT Pub. No.: WO00/07773

PCT Pub. Date: Feb. 17, 2000

(30) Foreign Application Priority Data

Aug. 3, 1998 (AU) ..... 1339/98

(51) Int. Cl.[7] ..... B22F 7/04

(52) U.S. Cl. ..... 428/545; 75/236; 75/242; 75/244; 419/12; 419/14; 419/33; 419/39

(58) Field of Search ..... 75/236, 240, 239, 75/242, 244; 419/12, 14, 33, 39; 428/545

(56) References Cited

U.S. PATENT DOCUMENTS

| | | | |
|---|---|---|---|
| 2,238,351 A | 4/1941 | Van Der Pyl | |
| 3,372,010 A | 3/1968 | Parsons | |
| 3,841,852 A | 10/1974 | Wilder et al. | 51/295 |
| 3,999,962 A | 12/1976 | Simonvich et al. | 51/307 |
| 4,505,746 A | 3/1985 | Nakai et al. | 75/243 |
| 5,755,299 A | 5/1998 | Langford et al. | 175/375 |

FOREIGN PATENT DOCUMENTS

| | | |
|---|---|---|
| DE | 2139386 | 2/1973 |
| DE | 2524307 | 1/1977 |
| EP | 0629472 | 12/1994 |
| GB | 2216543 | 10/1989 |
| GB | 2220420 | 1/1990 |
| JP | 4-15285 | 1/1992 |
| WO | 97/06339 | 2/1997 |
| WO | 98/25721 | 6/1998 |

OTHER PUBLICATIONS

Database WPI, Week 7702, Derwent Publications Ltd., London, GB; AN 1977–0277OY XP002122997 & JP 51 136506 A (Akebono Brake Kogyo KK), Nov. 26, 1976.

Patent Abstracts of Japan, vol. 007, No. 092 (M–208), Apr. 16, 1983 & JP 58 015671 A (Fuji Die Kogyo KK) Jan. 29, 1983.

Database WPI, Week 8236, Derwent Publications Ltd., London, GB; AN 1982–75992E XP002122998 & Su 878 551 B (Lvov Artif Diamonds), Nov. 7, 1981.

*Primary Examiner*—Ngoclan Mai
(74) *Attorney, Agent, or Firm*—Wenderoth, Lind & Ponack, L.L.P.

(57) ABSTRACT

The invention relates to an abrasive tool comprising a support body and at least one abrasive element connected thereto. Said abrasive element has an abrasive grain which is joined by a sintered metal. The sintered metal used for joining is copper-coated iron and is alloyed with metal borides, metal carbides and/or metal silicides and also with tin.

46 Claims, 5 Drawing Sheets

ABRASIVE TOOL

This application is a 371 application of PCT/AT99/00194 filed Aug. 3, 1999.

The invention relates to an abrasive tool with a supporting body and, connected thereto, at least one abrasive element with sintered metal bonded abrasive grain. The invention further relates to a method for manufacturing and use of such a tool. In particular, the invention relates to the manufacture and use of grinding, abrasive cutting, sawing or wood drilling tools made of diamond or respectively cubic boron nitride-containing sintered metallic bonded cutting segments, and supporting bodies of steel, to which the cutting segments are joined by brazing, welding or direct sintering on.

Such tools are used for shaping, cutting and drilling metal, glass, natural stone, artificial stone, concrete, ceramics, and plastics reinforced or not with fibres or fillers. These are abrasive processes for wet and dry use. The actual cutting material used is preferably a high performance abrasive medium such as cubic boron nitride or diamond, with grain sizes of 150 to 900 $\mu$m.

A task of the same importance as that of the cutting material is satisfied in abrasive tools according to the invention by the sintered metal bond. The following properties and tasks for an economic sintered metal bond for abrasive tools are known from the prior art:

There must be sufficient retention of the abrasive grain to prevent premature loss of abrasive grain. If the bond matrix is too soft, the abrasive grains can be loosened in their bond environment by the cutting forces on the cutting edges of the grains, which leads to premature grain loss with an uneconomical operating result. When too many cutting grains fall out prematurely, this also results in the operating conditions being made more difficult, characterised be high frictional losses on the contact surface between the body of the bond and the material to be worked on. Such operating conditions are manifested by high poster consumption, reduced drilling, grinding or cutting progress, and are often associated with increased noise and emission of sparks.

A further manifestation of excessively soft bond characteristics with respect to the diamond or cubic boron nitride high performance abrasive materials, is the risk of the cutting grains being impressed or pushed further into the bond. This risk occurs particularly when working without liquid cooling. FIG. 1 shows schematically the displacement of abrasive grain in a bond that has become pasty due to the influence of excessive heat. The effect is, as described hereinabove, frictional loss, high power consumption, spark emission, poor cutting performance and loud noise, as the cutting edges of the abrasive grains disappear beneath the surface of the bond.

In addition to providing retention for the grain, the wear behaviour of the bond must be optimised with respect to the workpiece material and its chippings, with respect to the work settings, and with respect to the cooling agent, namely air or cooling liquid. If the bond matrix wears excessively, the abrasive grains are prematurely worn out by the abraded chippings. Uneconomical working is again the result, as the grains are lifted out too quickly. When, on the other hand, the bond is made too wear-resistant, the abrasive grain is retained for too long, and this can lead to blunting because of the cutting edges becoming rounded, and thereby lead to a loss of the cutting properties.

In the manufacture, in particular in the mass-production of grinding, abrasive cutting and drilling tools containing abrasive grain for the construction and stone industries, the pressurised sinter compression method is used as a rule. The principle of short circuit current heating or respectively inductive heating is used to generate the heat required for the process.

For example, machines commercially available from the Dr Fritsch (DSP25AT, SPM 75), Sintris (18STV, 19ST3T) or Arga (CAR1001) companies can be used for this. With this, multi-part sintering moulds according to FIG. 2 are used, in which during sintering a thermal gradient generally occurs, as in the center of the segment to be sintered a temperature occurs sometimes up to 40° C. higher than in the outer areas of the segment. In pressurised sintering, which is normal in practice, when there is a liquid phase, this is more strongly expressed in the center region than in the edge regions, which leads to undesired non-homogeneity such as variation in mass texture and hardness, and can lead to blowing out.

The base metal mainly used for many years is cobalt. This metal has limited availability in terms of reserves. The price of cobalt is the subject of speculative transactions, in the same way as the price of silver or gold. Continuously increasing pressure on prices in the metal bonded high performance abrasives sector is forcing manufacturers of those materials to research alternatives. The replacement of cobalt with a single replacement material has proved technically impossible. These days, iron seems the most likely basic raw material as the price of iron is low and not the subject of speculative transactions.

The soft iron can be made slightly harder with copper. The maximum solubility of copper in $\alpha$ iron is 1.4 percent by weight, at 850° C. Tin makes iron harder, but also more brittle and can therefore only be used in small quantities in alloys (F. Rapatz: Die Edelstahle, 1962). In iron-copper alloys, carbon has a hardening effect by forming carbides with iron and by its effect on the $\gamma$-$\alpha$ transformation, but also causes brittleness and is difficult to weld. For these reasons, the alloy according to the invention is advantageously not alloyed with any carbon.

The addition of tungsten carbide increases wear resistance in cobalt bonds. With iron bonds, improvement in near resistance is also possible, although because of the low degree of intrinsic hardness of the iron bond, only to a limited extent.

The object of the present invention is to provide the iron bond system with, in addition to copper (tin), further alloying partners which, at normal manufacturing temperatures for tools containing super abrasive agents, of between 800 and 1000° C., satisfy as many as possible of the following requirements, namely

- increasing the intrinsic hardness of the iron bond in order to prevent displacement or impression of the grains of cutting material when there are difficult operating conditions in their bond environment as represented in FIG. 1,
- not causing brittleness, in order to make use, without breakage or respectively fissuring possible in manufacturing and in application,
- transforming the liquid phase caused by tin as quickly as possible into a solid alloy phase,
- retaining the high performance abrasive medium for as long as possible in the bond,
- not in any way chemically, thermally or mechanically damaging the high performance abrasive medium,
- matching as well as possible the bond wear to the wear of the high performance abrasive medium,
- particles being obtainable in sufficient quantity and sizes, available at an acceptable raw material price, as environmentally friendly as possible.

The object of the invention is above all an abrasive tool according to claim 1.

The different metal carbides, metal borides and metal silicides react to a small extent with the bond metals iron, copper and tin. The metal carbides of chromium, molybdenum and titanium react with iron and copper on the contact surfaces and thereby cause hardening of the bond metal by forming an intermetallic phase, and the particularly flood integration of these hardening materials. Chromium boride reacts to a small extent with iron, forming an intermetallic phase. These hardening materials are well bonded with the matrix, and increase wear resistance. The silicides of chromium and molybdenum react with iron and form different iron silicides, which are hard but brittle. The content of these hardening materials in iron bonds has therefore to be very carefully adjusted.

By coordinating the hardening material with the iron-copper-tin matrix, all the properties set out hereinabove can be satisfied by the metal bond according to the invention. It as shown that in order to satisfy all the requirements set out hereinabove, at least two metal carbides, metal borides, metal silicides or combinations thereof must be alloyed with the soft bond matrix. The more complex the task to be solved, the more hardening materials have to be used. Wear resistance can be further increased by the addition of tungsten carbide.

A feature of the alloy according to the invention is the obtaining of hardness values of up to approximately 120 degrees hardness according to Rockwell B (HRB) without any great loss of ductility. A bond according to the invention with approximately 10% coarse grain tungsten carbide and a hardness of 120 HRB achieves impact resistance of approximately 0.03 J/mm$^2$. A standard cobalt based, bond of the same hardness achieves 0.02 J/mm$^2$. An iron bond according to the prior art (with considerable addition of bronze, nickel and tungsten carbides) achieves only 0.01 J/mm$^2$ and is no longer producible with sufficient reliability.

The hardness of the copper covered iron powder is approximately 85 HRB after sintering. Tin increases the hardness of the basis of the bond to approximately 95 HRB. The hardness can be increased to approximately 105 HRB with chromium carbide. By addition of further metal borides and/or metal carbides, the hardness set out hereinabove, of 120 HRB, is obtained.

Each bond component makes possible the improvement of a tool characteristic. Metal borides in combination with metal carbides increase the hardness of iron bonds and reduce the bond wear in use. Using tin, the sintering temperature can be reduced to temperatures at which abrasive tools can be manufactured without damaging the abrasive grain. Some metal carbides regulate the amount of fluid phase and by their addition, increase the process reliability. Hardening effects of iron based materials can be obtained below 850° C. by addition of metal silicides.

BRIEF DESCRIPTION OF THE DRAWINGS

Hereinafter, the invention will be further described with reference to the attached drawings, graphs and images: There is shown in FIG. 1 a schematic representation of displacement of abrasive grains into an excessively soft sintered metal bond.

In cutting tests with sintered metal bonds composed according to the invention, which are predominantly made of high temperature melting, metal bond components, with an intermediate liquid phase, no grain displacements are evident. With these sintered metal bonds, a sufficiently large grain projection 4 was determined. In this way optimum grinding, cutting and drilling behaviour could be observed.

Figure 1:
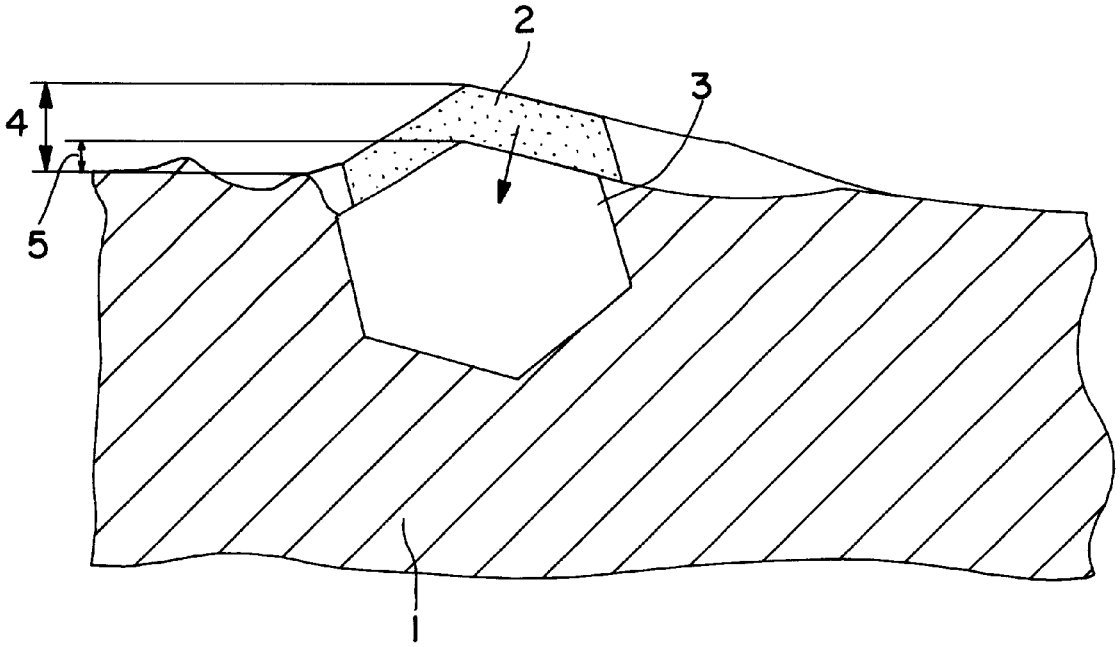
FIG. 1 shows a cutting grain before 2 and after 3 displacement or respectively impression when using a sintered metal bond 1 with softening, low temperature melting alloy components such as Cu, Sn, Ag, and alloys thereof. The insufficient grain projection 5 from the excessively soft sintered metal bond leads to the difficult working conditions described hereinabove (high power consumption, reduced cutting progress, and so forth).
Figure 2:
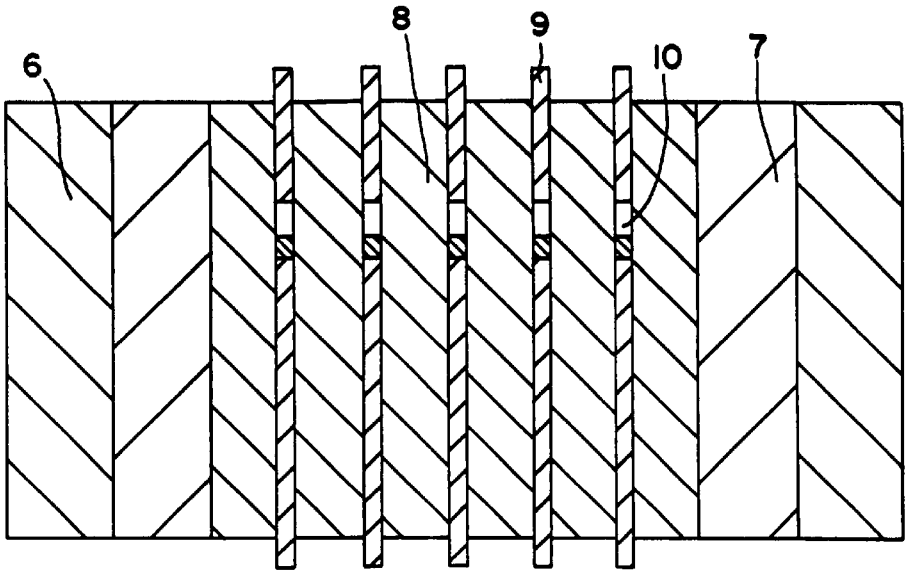
FIG. 2 an elementary representation of a multiple sintering mould for manufacturing cutting segments according to the invention.
Figure 2:
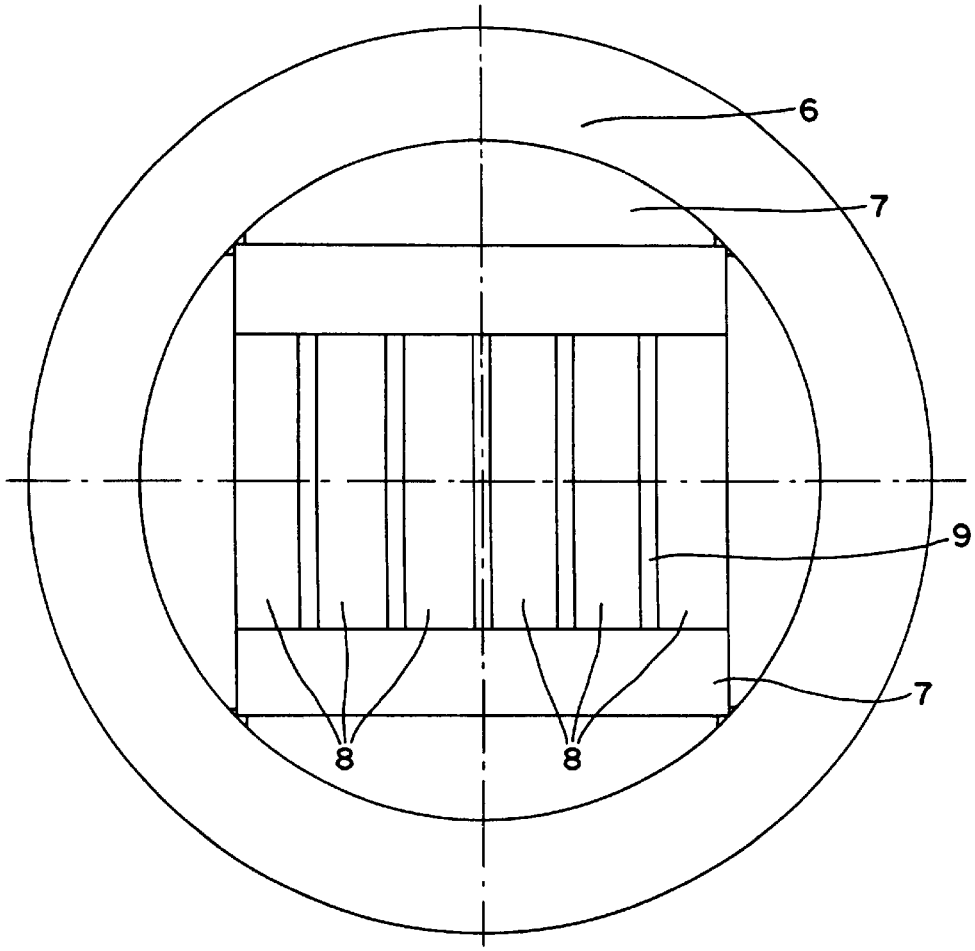

FIG. 2 shows an elementary representation of a multiple sintering mould for manufacturing cutting segments according to the invention, as used in the example of production of cutting segments according to the invention, described hereinafter.

Graphite is preferably used as the material for the sintering moulds. The moulds are composed of the supporting rings 6, the internal parts 7, the separating plates 8 between the sediments, and the pressure die 9. The arrangement of the segments 10 is in the center of the sintering mould, in order to make possible a homogeneous temperature. In FIG. 2, segments with a neutral zone are represented.

Figure 3:
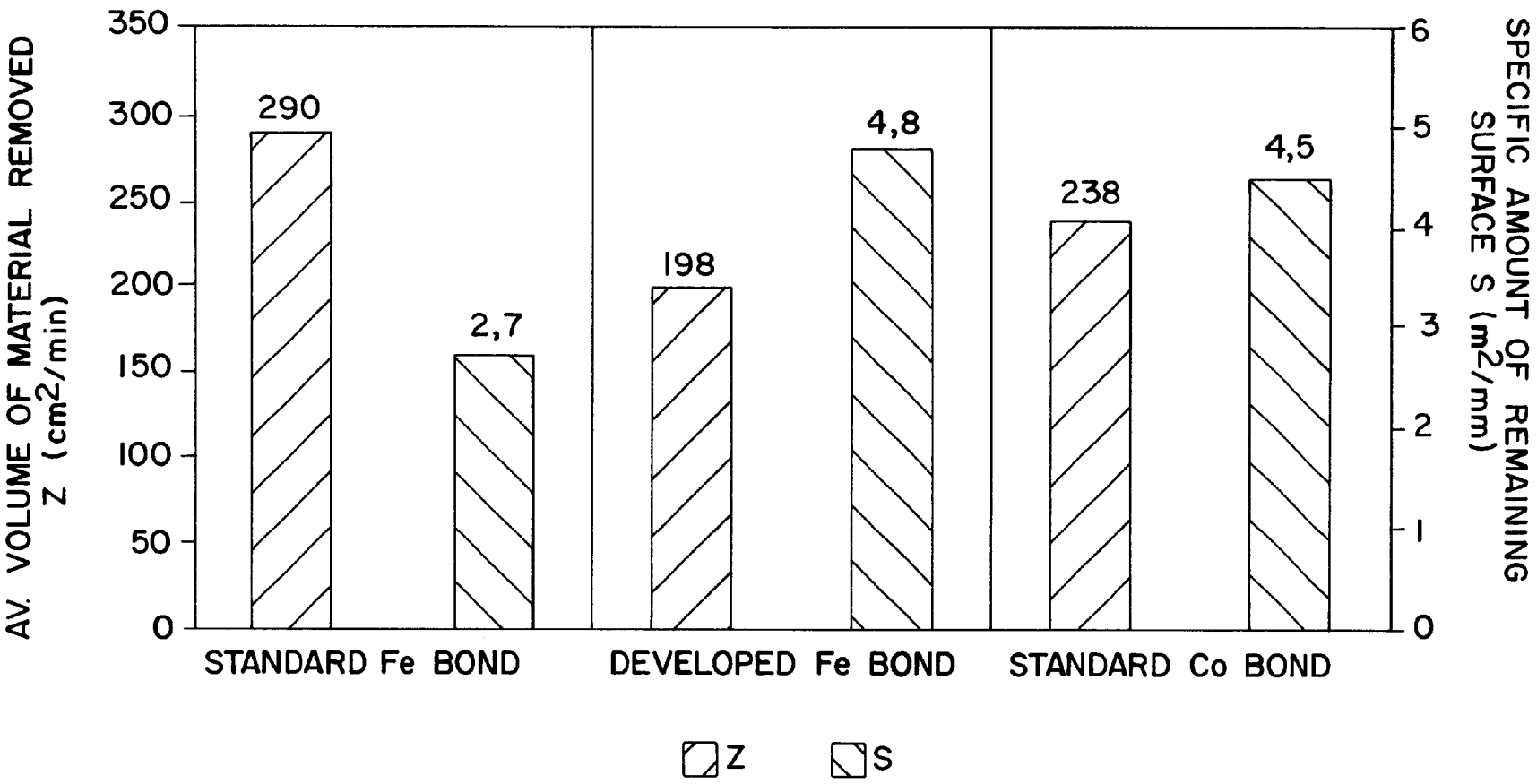
FIG. 3 a graph of the cutting results of the alloy according to the invention compared to the standard bond used until now for the application, and an iron bond according to the prior art.

FIG. 3 shows a comparison of the test results with the alloy according to the invention, compared to the results of a normally used cobalt alloy and an iron bond according to the state of the art.

Saw blades with a 300 mm diameter where manufactured as tools. The tools were mounted on an abrasive cutting machine. Exposed aggregate concrete panels were used as the material to be worked. Vertical swinging cuts were carried out with water irrigation. 60 cuts were made with each saw.

The specific volume of material removed Z, being, one of the most important parameters for abrasive cutting processes is greatest (290 cm$^2$/min), using bonds with known iron bonds according to the prior art. The proven, standard, cobalt-based bond has a volume of material of 238 cm$^2$/min removed. The novel iron alloy according to the invention achieves a comparable volume of material (198 cm$^2$/min) removed.

If the specific remaining surface of the individual tools is viewed, it is evident that the conventional iron bond (2.7 m$^2$/mm remaining surface) is much more worn than the standard cobalt bond (4.5 m$^2$/mm remaining surface). Such wear values are not as a rule accepted by the end-user. The alloy according to the invention achieved a remaining surface of 4.8 m$^2$/mm and thereby exceeds the previous cobalt bond by approximately 7%.

The tested alloys were prepared from the following powder mixtures:

(a) The iron bond according to the invention composed of 91 percent by weight copper covered (preferably spherical) iron powder (average particle size between 4 and 6 $\mu$m), 2 percent by weight chromium boride (particle size ~10 $\mu$m), 2 percent by weight chromium carbide (particle size ~10 $\mu$m), 1 percent by weight tin (particle size 4 to 15 μm), and 4 percent by weight molybdenum carbide (particle size ~3 μm).

(b) The cobalt bond according to the prior art, composed of 94 percent by weight cobalt (extra fine), and 6 percent by weight tungsten carbide (particle size>10 μm).

(c) the iron bond according to the prior art, composed of 50 percent by weight iron (90 to 30 μm), 4 percent by weight nickel (approximately 5 μm), 9 percent by weight copper (approximately 5 μm), 22 percent by weight bronze 80/20 (8 to 16 μm) and 15 percent by weight tungsten carbide (particle size>10 μm).

The manufacture of the cutting segments was the same in principle for all three metal alloys, some parameters such as compression power and sintering temperatures were different. Hereinafter, the process parameters of the metal alloy according to the invention will be described.

The quantities of powder were weighed in the composition according to the invention. Mixing was carried out with an intensive mixer. The mixture was subsequently wetted with 1% paraffin oil mixture. The powder mixture was processed with a granulating apparatus (apparatus for rolled granulate) into a granulate. The granulate of the metal alloy according to the invention was subsequently mixed with synthetic diamonds with a grain size of 300 to 600 μm, wherein the concentration of diamond in the sintered segment was 0.428 carat/cm$^3$.

The diamond-granulate mixtures were pre-compressed, for example with 3 to 4 metric tons in a normally used cold press (for example, from the Frisch or Dorst companies). In the greens, the neutral zone, composed of iron-based granulate, was filled and subsequently cold compressed again with 3 to 4 metric tons of pressure. In multi-part graphite sintering moulds according to FIG. 2, the greens were completely sintered at 950° C., at a sintering pressure of 3 kN/cm$^2$, and a sintering temperature duration of 5 minutes.

In each case, 18 segments were unwelded onto a steel parent blade using a laser welding machine (for example Rofin-Sinar). The comparison test with a tool with the standard bond then followed. The tool according to the invention proved better with respect to the remaining surface, and approximately the same with respect to the volume of material removed.

Further test results with an alloy according to the invention for a completely different area of use, compared to the results of a normally used alloy, also produced results conforming to the requirements.

Saw blades with an 800 mm diameter were manufactured as tools. The tools were mounted on a stationary, high-powered machine. Calcareous sandstone was used as the material to be worked. The tool was tested in wet cutting, wherein the test lasted several weeks.

The metal alloy according to the invention proved considerably readier to cut, in comparison with metal bonds used until now. Half way through the duration of the test, and after termination of the test, the remaining segment height was measured and the wear calculated from this. The metal alloy according to the invention had a slightly higher degree of wear, which can be reduced by slight adjustment to the composition of the alloy composition according to the invention, and by adjustment to the type, size or concentration of the super abrasive material.

The alloys tested were produced from the following powder mixtures:

a) the iron bond according to the invention composed of 70 percent by weight copper covered iron powder (average particle size between 4 and 6 μm), 3 percent by weight chromium boride (particle size ~10 μm), 5 percent by weight chromium carbide (particle size ~10 μm), 2 percent by weight tin (particle size 4 to 15 μm), 8 percent by weight molybdenum carbide (particle size ~3 μm), 4 percent by weight tungsten carbide with grain size 2 to 4 μm, and 8 percent by weight tungsten carbide with grain size between 150 and 250 μm.

b) The standard bond according to the prior art, composed of 21 percent by weight cobalt (extra fine), 4 percent by weight nickel (approximately 5 μm), 6 percent by weight copper (15 to 30 μm), and 60 percent by weight tungsten carbide (particle size between 2 and 100 μm).

The manufacture of the cutting segments was the same in principle for both metal alloys, some parameters such as pressing force and sinter temperatures were different. Hereinafter, the process parameters of the metal alloy according to the invention will be set out.

The quantities of powder were weighed in the composition according to the invention. Mixing was carried out with an intensive mixer (for example, from the Gustav Eirich machine factory). The mixture was subsequently wetted with 1% paraffin oil mixture. The powder mixture of the metal alloy according to the invention was subsequently mixed with synthetic diamonds with a grain size of 300 to 600 μm, wherein the concentration of diamond in the sintered segment was 1,584 carat/cm$^2$.

The diamond-powder mixtures were pre-compressed with 3 to 4 metric tons in a normally used cold press (for example, from the Fritch or Dorst companies). In multi-part graphite sintering moulds according to FIG. 2, the greens were completely sintered at 950° C., a sintering pressure of 3.8 kN/cm$^2$, and a sintering temperature duration of 5 minutes.

Comparison of the hardness X values between the standard bond (119 HRB) and metal alloy according to the invention (116 HRB) produced no significant differences. The metal alloy according to the invention is more ductile by a factor of 3, than the standard bond, and therefore more reliable in production an application. A further advantage is the sintering temperature of the metal alloy according to the invention, of up to 100° C. lower by comparison.

In each case, 46 segments were brazed onto a steel master blade, using a brazing machine. The test in comparison with a tool with the standard bond was subsequently done. The tool according to the invention proved of equal value with respect to the remaining surface, and clearly better with respect to the cutting speed.

Overall, it proved advantageous that the amount of copper covered iron powder in the sintered metal bond was 60 to 85 percent by weight, preferably 70 to 90 percent by weight, wherein the amount of copper on the copper covered iron was 9 to 30 percent by weight.

A soft bond is obtained by means of the following sintered metal bond composition:

| | |
|---|---|
| 90 to 95 | percent by weight copper coated iron, |
| 0.5 to 2 | percent by weight metal boride(s), preferably chromium boride, |
| 3 to 4 | percent by weight metal carbide(s), preferably chromium carbide and molybdenum carbide, and |
| 2 to 4 | percent by weight tin. |

An intermediate bond is obtained by means of the following sintered metal bond composition:

| | |
|---|---|
| 89 to 94 | percent by weight copper coated iron, |
| 1 to 3 | percent by weight metal boride(s), preferably chromium boride |
| 6 to 8 | percent by weight metal carbide(s), preferably chromium carbide and molybdenum carbide, and |
| 0.5 to 3 | percent by weight tin. |

A hard bond is obtained by means of the following sintered metal bond composition:

| | |
|---|---|
| 62 to 70 | percent by weight copper coated iron |
| 1.5 to 3 | percent by weight metal carbide(s), preferably chromium carbide, molybdenum carbide and/or tungsten carbide, and |
| 0.5 to 3 | percent by weight tin. |

Figure 4:
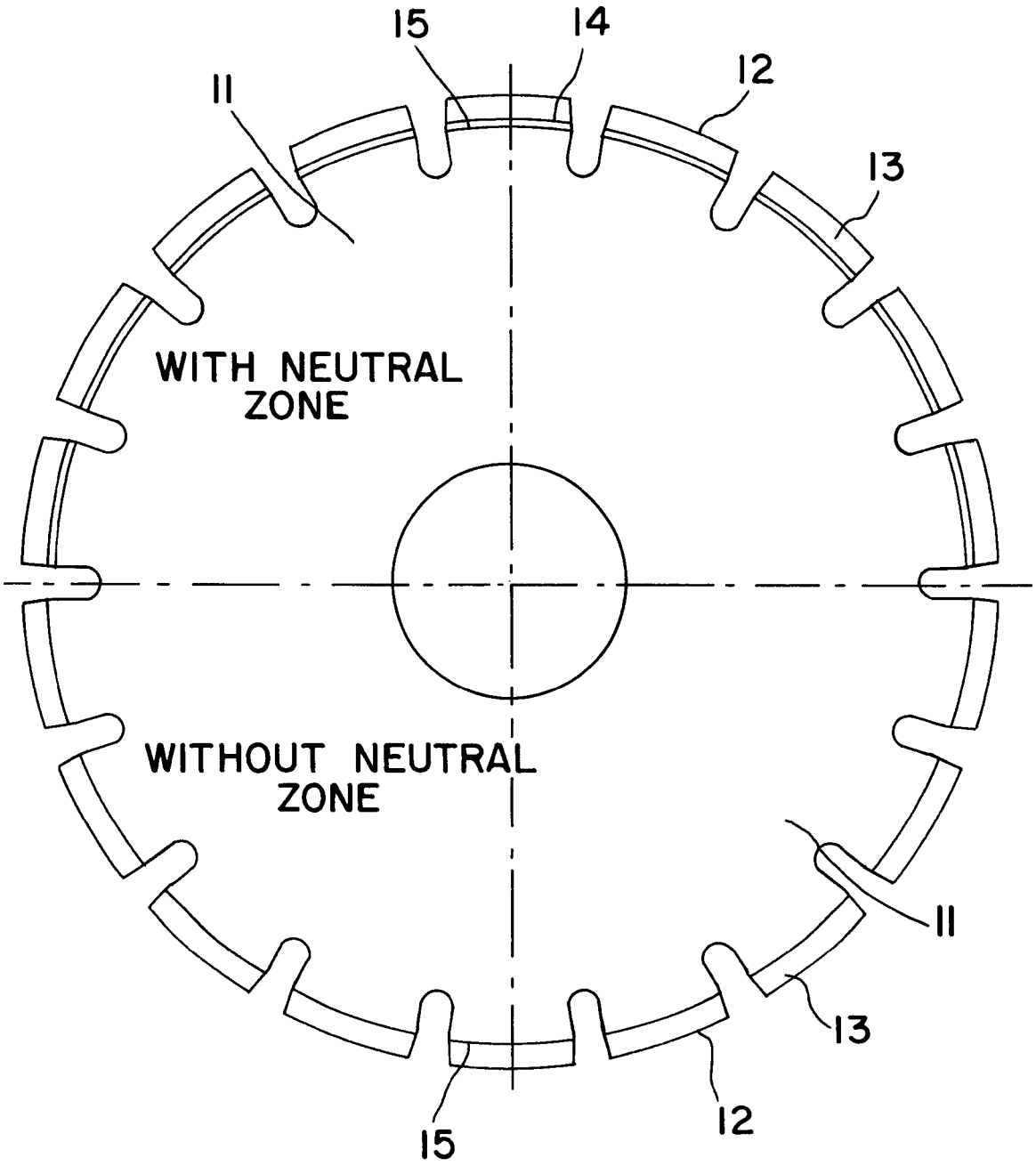
FIG. 4 an elementary representation of a cutting tool according to the invention, FIG. 5 an elementary representation of a drilling tool according to the invention.

FIG. 4 shows an elementary representation of a cutting tool. The parent blade 11 is preferably of steel. The diameter of the parent blade and the diameter of the internal bore depends on the respective use. The segments 13 with or without a neutral zone 14 are joined by welding, brazing, or sintering to the parent blade. The joint 15 between the parent blade and segment is of varying strength, according to which process is selected. The surface 12 of the segments 13 is sharpened before the tool is used, in order to make an optimum readiness to cut possible just before starting.

Figure 5:
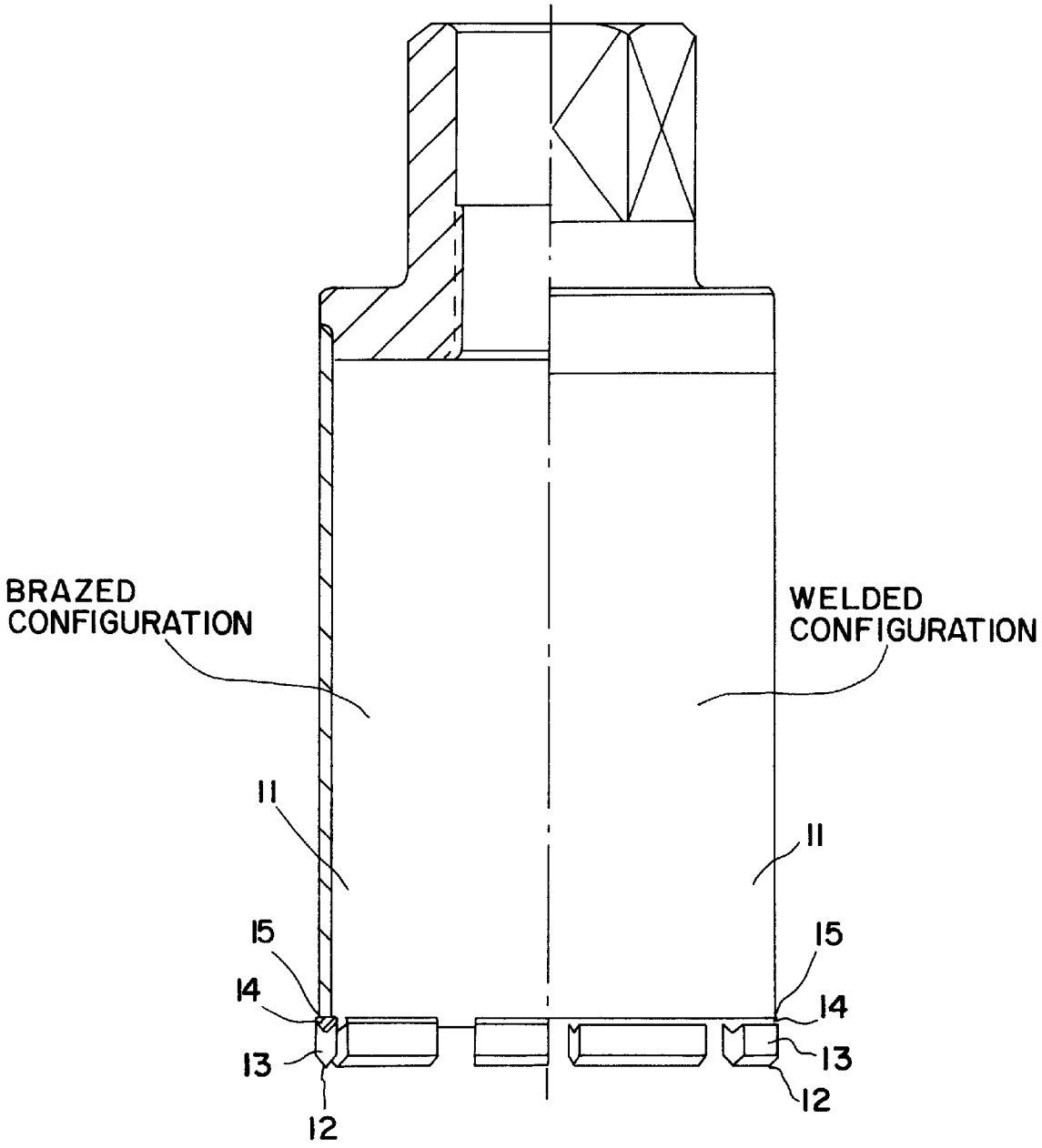

FIG. 5 shows an elementary representation of a drilling tool according to the invention. The supporting tube 11 is preferably composed of steel. The segments 13 are produced with a roof-like point. Because of this roof, the drilling-in phase with respect to the arrangement of the tool in a neutral zone is also required. The joining seam 15 is optically and mechanically examined before delivery of the tool.

What is claimed is:

1. Abrasive tool comprising a supporting body and, connected thereto, at least one abrasive element with sintered metal bonded abrasive grain, wherein the sintered metal bond is manufactured from copper coated iron powder, and is alloyed with metal boride, metal carbide and/or metal silicide as metallic hardening agents, and also with tin, wherein at least two of the metallic hardening agents described are respectively present in a quantity of 0.5 percent by weight to 10 percent by weight with respect to the whole sintered metal bond, and wherein the amount of tin is at least 0.2 percent by weight, also with respect to the whole sintered metal bond.

2. Abrasive tool according to claim 1, wherein the metal borides are borides of metals selected from the group consisting of chromium, molybdenum, silicon, tantalum, titanium, tungsten and zirconium.

3. Abrasive tool according to claim 1, wherein the metal boride is chromium boride (CrB).

4. Abrasive tool according to claim 1, wherein the grain size of the metal boride powder is 2 to 20 $\mu$m.

5. Abrasive tool according to claim 1, wherein the amount of metal borides in the sintered metal bond is 0.25 to 12 percent by weight.

6. Abrasive tool according to claim 1, wherein the metal carbides are carbides of metals selected from the group consisting of chromium, molybdenum, titanium, vanadium and tungsten, and the metal silicides are silicides of metals selected from the group consisting of chromium, molybdenum, titanium and zirconium.

7. Abrasive tool according to claim 1, wherein the metal carbides are chromium carbide ($Cr_3C_2$), molybdenum carbide ($Mo_2C$) and/or tungsten carbide (WC), and the metal silicides are molybdenum silicide ($MoSi_2$) and/or chromium silicide ($CrSi_2$).

8. Abrasive tool according to claim 7, wherein the grain size of the chromium carbide is 2 to 20 $\mu$m.

9. Abrasive tool according to claim 7, wherein the grain size of the molybdenum carbide is 0.5 to 15 $\mu$m.

10. Abrasive tool according to claim 7, wherein the grain size of the tungsten carbide is 0.2 to 300 $\mu$m.

11. Abrasive tool according to claim 7, wherein the grain size of the molybdenum silicide is 0.5 to 15 $\mu$m.

12. Abrasive tool according to claim 7, wherein the grain size of the chromium silicide is 2 to 20 $\mu$m.

13. Abrasive tool according to claim 1, wherein the following amounts of metal carbides and metal silicides are contained in the sintered metal bonds:

| | |
|---|---|
| chromium carbide: | 0 to 15 percent by weight |
| molybdenum carbide: | 0 to 15 percent by weight |
| tungsten carbide: | 0 to 30 percent by weight |
| chromium silicide: | 0 to 15 percent by weight |
| molybdenum silicide | 0 to 15 percent by weight. |

14. Abrasive tool according to claim 1, wherein the composition of the sintered metal bond comprises:

| | |
|---|---|
| 90 to 95 | percent by weight copper coated iron, |
| 0.5 to 2 | percent by weight metal boride(s), |
| 3 to 4 | percent by weight metal carbide(s), and |
| 2 to 4 | percent by weight tin. |

15. Abrasive tool according to claim 1, wherein the composition of the sintered metal bond comprises:

| | |
|---|---|
| 89 to 94 | percent by weight copper coated iron, |
| 1 to 3 | percent by weight chromium boride(s), |
| 6 to 8 | percent by weight metal carbide(s), and |
| 0.5 to 3 | percent by weight tin. |

16. Abrasive tool according to claim 1, wherein the composition of the sintered metal bond comprises:

| | |
|---|---|
| 62 to 70 | percent by weight copper coated iron, |
| 1.5 to 3 | percent by weight of metal carbide(s), and |
| 0.5 to 3 | percent by weight tin. |

17. Abrasive tool according to claim 1, wherein the copper coated iron powder is based on spherical carbonyl iron powder.

18. Abrasive tool according to claim 1, wherein the particle size of the iron powder is 2 to 15 $\mu$m.

19. Abrasive tool according to claim 1, wherein the amount of copper on the copper coated iron is 9 to 30 percent by weight.

20. Abrasive tool according to claim 1, wherein the amount of tin in the sintered metal bond is at most 10 percent by weight.

21. Abrasive tool according to claim 1, wherein the amount of copper coated iron powder in the sintered metal bond is 50 to 95 percent by weight.

22. Abrasive toot according to claim 1, wherein the supporting body is of steel.

23. Abrasive tool according to claim 1, wherein the abrasive elements are configured as cutting or respectively grinding segments.

24. Abrasive tool according to claim 1, wherein the abrasive elements are bonded by brazing, welding or sintering to the support.

25. Method for manufacturing an abrasive tool according to claim 1 comprising:

a) dry mixing components to produce a powder mixture, b) optionally granulating the powder mixture, c) mixing the powder mixture or respectively the granulate with a cutting agent or respectively the abrasive grain using a wetting agent, d) pre-compressing the cutting agent-powder (or respectively, granulate) mixture between the bottom die and top die of a mould, e) optionally applying a powder mixture according to a) to the pre-compressed cutting agent-powder mixture, f) completely compressing the powder mixture and the cutting agent-powder mixture together between a bottom die and a top die to form a green body, g) sintering of the green body, and h) joining cutting segments of the sintered material to a supporting body on the common joint surface, wherein the powder mixture according to a) comprises a copper coated, spherical iron powder, the metal borides, metal carbides and/or metal suicides, and tin, and wherein the amount of coated iron powder is between 50 and 95 percent by weight.

26. Method for manufacturing an abrasive tool according to claim 1, comprising:

a) dry mixing components to produce a powder mixture, b) optionally granulating the powder mixture, c) mixing the powder mixture or respectively the granulate with a cutting agent or respectively the abrasive grain using a wetting agent, d) pre-compressing the cutting agent-powder (or respectively, granulate) mixture between the bottom die and top die of a mould directly on a steel support, e) direct sintering on of the pre-compressed cutting/grinding coating in a steel mould, wherein the powder mixture according to a) comprises a copper coated spherical iron powder with a grain size of 2 to 15 $\mu$m, the metal borides, metal carbides and/or metal suicides, and tin, and wherein the amount of coated iron powder is between 50 and 95 percent by weight.

27. A method which comprises grinding, abrasive cutting, sawing or drilling a mineral or mineral-containing workpiece with an abrasive tool according to claim 1.

28. Abrasive tool according to claim 4, wherein the grain size of the metal boride powder is 4 to 10 $\mu$m.

29. Abrasive tool according to claim 5, wherein the amount of metal borides in the sintered metal bond is 3 to 8 percent by weight.

30. Abrasive tool according to claim 8, wherein the grain size of the chromium carbide is 6 to 15 $\mu$m.

31. Abrasive tool according to claim 9, wherein the grain size of the molybdenum carbide is 1 to 5 $\mu$m.

32. Abrasive tool according to claim 11, wherein the grain size of the molybdenum silicide is 1 to 5 $\mu$m.

33. Abrasive tool according to claim 12, wherein the grain size of the chromium silicide is 6 to 15 $\mu$m.

34. Abrasive tool according to claim 13, wherein the following amounts of metal carbides and metal silicides are contained in the sintered metal bonds:

| | |
|---|---|
| chromium carbide: | 1.5 to 7 percent by weight |
| molybdenum carbide: | 1 to 8 percent by weight |
| tungsten carbide: | 0 to 30 percent by weight |
| chromium silicide: | 1 to 7 percent by weight |
| molybdenum silicide | 1 to 7 percent by weight. |

35. Abrasive tool according to claim 14, wherein the composition of the sintered metal bond comprises:

| | |
|---|---|
| 90 to 95 | percent by weight copper coated iron, |
| 0.5 to 2 | percent by weight chromium boride, |
| 3 to 4 | percent by weight of chromium carbide and molybdenum carbide, and |
| 2 to 4 | percent by weight tin. |

36. Abrasive tool according to claim 15, wherein the composition of the sintered metal bond comprises:

| | |
|---|---|
| 89 to 94 | percent by weight copper coated iron, |
| 1 to 3 | percent by weight chromium boride, |
| 6 to 8 | percent by weight chromium carbide and molybdenum carbide, and |
| 0.5 to 3 | percent by weight tin. |

37. Abrasive tool according to claim 16, wherein the composition of the sintered metal bond comprises:

| | |
|---|---|
| 62 to 70 | percent by weight copper coated iron, |
| 1.5 to 3 | percent by weight of chromium carbide, molybdenum carbide and/or tungsten carbide, and |
| 0.5 to 3 | percent by weight tin. |

38. Abrasive tool according to claim 18, wherein the particle size of the iron powder is 4 to 7 $\mu$m.

39. Abrasive tool according to claim 20, wherein the amount of tin in the sintered metal bond is 1 to 5 percent by weight.

40. Abrasive tool according to claim 21, wherein the amount of copper coated iron powder in the sintered metal bond is 70 to 90 percent by weight.

41. The method for manufacturing an abrasive tool according to claim 25, wherein the powder mixture in e) is free of the cutting agent.

42. The method for manufacturing an abrasive tool according to claim 25, wherein the green body is sintered in a multiple mould.

43. The method for manufacturing an abrasive tool according to claim 25, wherein the copper coated, spherical iron powder has a grain size of 2 to 15 $\mu$m.

44. The method for manufacturing an abrasive tool according to claim 25, wherein the amount of coated iron powder is 70 to 90 percent by weight.

45. The method for manufacturing an abrasive tool according to claim 26, wherein the amount of coated iron powder is 70 to 90 percent by weight.

46. The method according to claim 27, wherein the workpiece is natural or artificial stone, ceramic, concrete, asphalt or filled plastics.

* * * * *

UNITED STATES PATENT AND TRADEMARK OFFICE

CERTIFICATE OF CORRECTION

PATENT NO. : 6,338,907 B1
DATED : January 15, 2002
INVENTOR(S) : Wolfgang Strelsky It is certified that error appears in the above-identified patent and that said Letters Patent is hereby corrected as shown below:

Title page,
Item [73], Assignee change "(AU)" to -- (AT) --.

Signed and Sealed this

Twenty-seventh Day of August, 2002

*Attest:*

*Attesting Officer*

JAMES E. ROGAN
*Director of the United States Patent and Trademark Office*